US005398368A

United States Patent [19]

Elder

[11] Patent Number: 5,398,368

[45] Date of Patent: Mar. 21, 1995

[54] TOOTHBRUSH

[76] Inventor: Sherri A. Elder, P.O. Box 524, Syracuse, Ind. 46567

[21] Appl. No.: 216,292

[22] Filed: Mar. 23, 1994

[51] Int. Cl.[6] ..... A46B 9/04

[52] U.S. Cl. ..... 15/167.1; 15/110; 15/160; 15/DIG. 5

[58] Field of Search ..... 15/110, 159.1, 160, 15/167.1, 207.2, DIG. 5; D4/104–112, 134

[56] References Cited

U.S. PATENT DOCUMENTS

| | | | |
|---|---|---|---|
| 28,794 | 6/1860 | Wadsworth | D4/104 |
| D. 99,364 | 4/1936 | Paisley . | |
| 313,776 | 3/1885 | Sebring | 15/160 |
| D. 330,286 | 10/1992 | Curtis et al. . | |
| D. 333,918 | 3/1993 | Curtis et al. . | |
| D. 334,472 | 4/1993 | Curtis et al. . | |
| 669,402 | 3/1901 | Rose | 15/167.1 |
| 1,452,108 | 4/1923 | Carter | 15/167.1 |
| 1,696,433 | 12/1928 | Faubert | 15/167.1 |
| 4,360,940 | 11/1982 | Smith | 15/160 |
| 4,616,374 | 10/1986 | Novogrodsky | 15/207.2 |

FOREIGN PATENT DOCUMENTS

| | | | |
|---|---|---|---|
| 2624360 | 6/1989 | France | 15/167.1 |
| 1171869 | 6/1964 | Germany | 15/167.1 |
| 1933458 | 1/1971 | Germany | 15/207.2 |
| 11600 | of 1884 | United Kingdom | 15/160 |

*Primary Examiner*—David A. Scherbel
*Assistant Examiner*—Randall E. Chin
*Attorney, Agent, or Firm*—Richard C. Litman

[57] ABSTRACT

The present invention relates to a toothbrush utilized for properly cleaning all teeth, including hard to reach back teeth. It includes a tapering head having bristles extending outward from its end. This toothbrush improves the quality of brushing by being configured to be readily maneuverable within confined portions of a user's mouth. The brushing surface formed by the bristles is substantially planar with the distance between adjacent bristles being substantially consistent throughout the head. This assures an even cleaning of the teeth, and also provides for even wear of the bristles.

4 Claims, 1 Drawing Sheet

10
20
22
24
26
28
30
32
34
36
38
40
42
44
46
48
A

TOOTHBRUSH

BACKGROUND OF THE INVENTION

1. Field of the Invention

The present invention relates to a toothbrush utilized for properly cleaning all teeth, including hard to reach back teeth. More specifically, the present invention relates to a toothbrush having a tapered head with bristles extending past the toothbrush end.

2. Description of the Prior Art

A problem frequently encountered during brushing of teeth concerns cleaning hard to reach back teeth. As most toothbrushes are not configured to be comfortably and effectively placed within the back of a person's mouth, brushing hard to reach back teeth often results in the end of the toothbrush repetitively contacting the user's cheeks and/or gums. This leads to pain and soreness which discourage proper brushing.

One method of facilitating proper cleaning of back teeth is to provide a toothbrush with bristles extending past the end of the toothbrush. With this type of arrangement, the bristles reach the back teeth without the person brushing having to uncomfortably force the brush into their mouth. Brushes having this type of bristle configuration are known in the prior art.

U.S. Pat. No. 669,402 issued to Carl Rose on Mar. 5, 1901, teaches a toothbrush having a pointed cone of bristles extending from the top most face of a brush back. These bristles are arranged obliquely to the brush back such that a part of the pointed cone projects beyond the foremost end of the toothbrush. This allows the cone to reach the sides and rear surfaces of the hindmost molars.

German Pat. No. 1 171 869 issued to Ingeborg Nelken on Jun. 11, 1964, depicts a tapering toothbrush which forms a tip at its outermost end. A portion of the bristles fastened to the top surface of the toothbrush are arranged diagonally so that they extend past the outermost end of the toothbrush. These diagonal bristles rise slightly above the others and are bent into barbed hooks that face the brush handle.

U.S. Pat. No. 1,696,433 issued to Harry W. Faubert on Mar. 20, 1928, illustrates a denture brush having a rounded end and bristles extending from the surfaces of both the top and bottom of the brush head. These bristles are angled relative to the brush head such that the bristles extend past the end of the brush head.

Other patents relating to brushes having bristles extending past the toothbrush end are U.S. Pat. Des. No. 99,364 issued to Ray A. Paisley on Apr. 21, 1936, U.S. Pat. Des. No. 330,286 issued to John P. Curtis et al. on Oct. 20, 1992, U.S. Pat. Des. No. 333,918 issued to John P. Curtis et al. on Mar. 16, 1993, and U.S. Pat. Des. No. 334,472 issued to John P. Curtis et al. on Apr. 6, 1993. The Paisley patent illustrates a brush having a plurality of bristles arranged in bundles and configured to extend past the end and sides of the brush. The three patents issued to Curtis et al. also show bristles arranged in bundles. A pair of these bundles, proximate to the end of the brush head, are angled in relation to the top surface of the brush, and therefore extend outward from the end of the brush head.

None of the above inventions and patents, taken either singly or in combination, is seen to describe the instant invention as claimed.

SUMMARY OF THE INVENTION

The present invention relates to a toothbrush utilized for properly cleaning all teeth, including hard to reach back teeth. It includes a tapering head for easy insertion into the back of a user's mouth. This head includes a top face and an end, both of which have bristles extending therefrom. A portion of these bristles are angled with respect to the top face, such that they extend past the end of the toothbrush. This allows the bristles to reach difficult to clean back teeth. The brushing surface formed by the bristles is substantially planar, with the distance between adjacent bristles being substantially consistent throughout the head. This assures both an even polish of the teeth and an even wear of the bristles.

Accordingly, it is a principal object of the invention to provide a novel toothbrush utilized for effectively cleaning hard to reach back teeth.

It is another object of the invention to provide a novel toothbrush having bristles extending past the end of the toothbrush head.

It is a further object of the invention to provide a novel toothbrush having bristles extending from both the top face and end of the toothbrush head.

It is a further object of the invention to provide a novel toothbrush having a tapered head.

Still another object of the invention is to provide a novel toothbrush having a substantially planar brushing surface.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figures 1, 2, 3, 4:
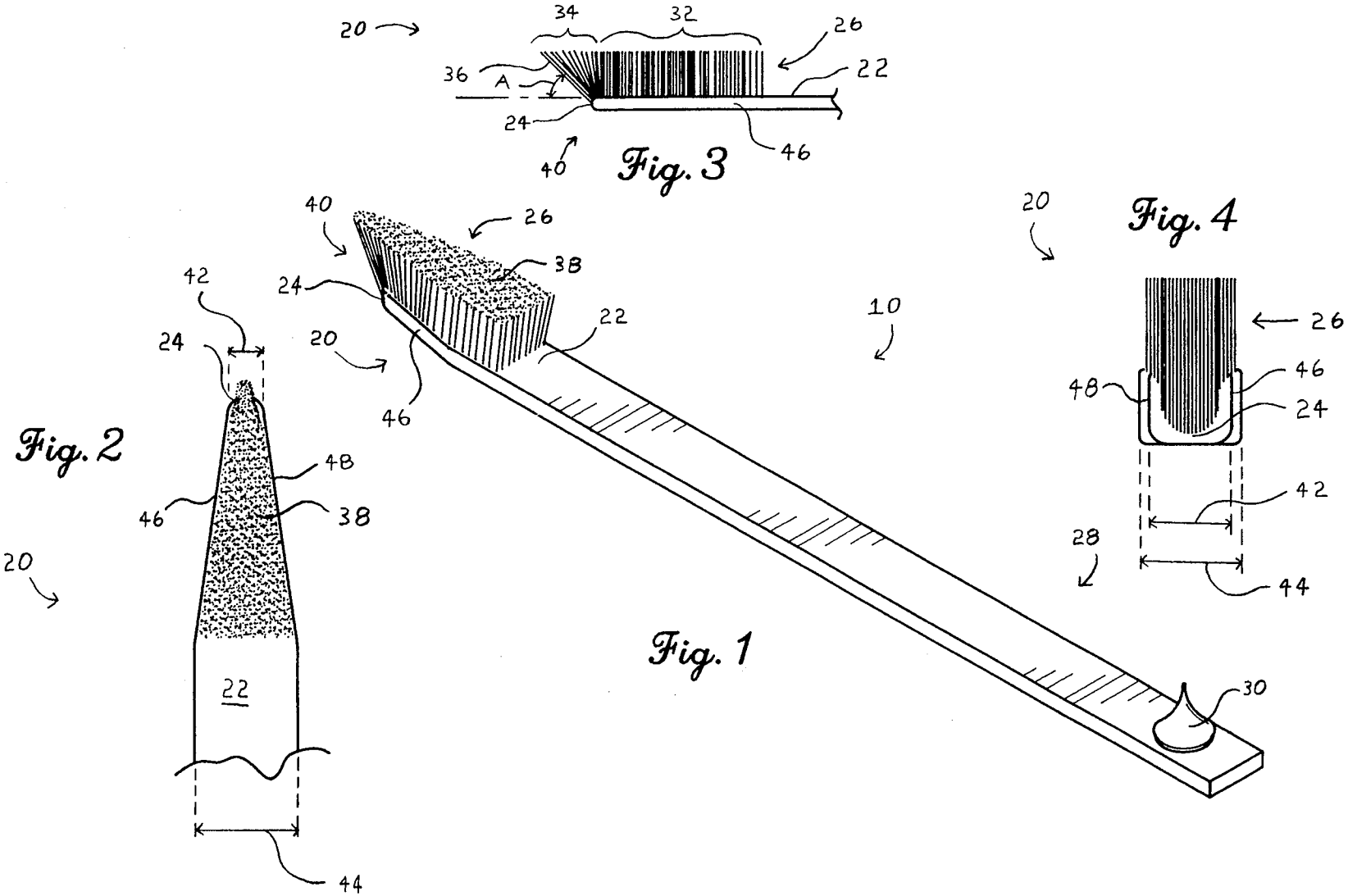
FIG. 1 is a perspective view of the toothbrush of the present invention.
FIG. 2 is a partial, top plan view of the head of the toothbrush of FIG. 1.
FIG. 3 is a partial, side elevational view of the head of the toothbrush of FIG. 1.
FIG. 4 is an enlarged scale, front view of the toothbrush of FIG. 1.

Referring now to FIG. 1, the toothbrush 10 of the present invention includes a head 20 having a top face 22, a first end surface 24 substantially perpendicular to the top face, and a plurality of bristles 26. Integral with first end 24 is an elongated handle 28 for grasping by the user. Although this handle 28 is shown to be substantially flat with a toothpick 30 at one of its ends, the design of handle 28 is not an essential component to the present invention, and may be fabricated in any shape or form.

As shown most clearly in FIG. 3, plurality of bristles 26 includes standard bristles 32 and extending bristles 34. Each of the standard bristles 32 is angled at approximately 90 degrees with respect-to top face 22, and each of the extending bristles 34 is angled at less than 90 degrees with respect to top face 22. Each of the standard bristles 32 and extending bristles 34 define an angle greater than 45 degrees relative to the top face 22. Therefore, extending bristles 34 are attached to and extend from the first end surface 24 and project beyond first end 24 in a direction away from the handle, providing toothbrush 10 with additional reach for cleaning hard to access back teeth. This improves the overall cleaning of the user's teeth without the user having to make an extraordinary effort or change his or her brushing habits.

The extending bristles, directly adjacent to standard bristles 32, are attached to toothbrush 10 at an angle slightly less than 90 degrees with respect to top face 22. Successive extending bristles 34 are then attached to the toothbrush at progressively decreasing angles, until the endmost bristle 36 is attached, and the brushing surface 38 is complete.

The angle A of the endmost bristle 36 directly relates to the reach of toothbrush 10. A small angle A corresponds to a considerable reach, while a large angle A corresponds to a modest reach. The optimal angle A for bristle 36 is slightly greater than 45 degrees. This angle A is small enough that toothbrush 10 has a substantial reach, but it is large enough that extending bristles 34 cannot damage the user's cheeks and/or gums.

With a toothbrush 10 having extending bristles 34, the user does not have to be concerned about irritation and soreness that may arise from the material of first end 24 contacting the back of his or her mouth. In the event that toothbrush 10 is pushed too deeply inside the user's mouth, the extending bristles 34 contact the back of the user's mouth, alerting him or her that toothbrush 10 should not be pushed any farther. When a toothbrush not having extending bristles 34 is pushed too far inside the user's mouth, there is no warning before the material of the toothbrush end contacts the back of the his or her mouth. If this contacting between the toothbrush end and the back of the user's mouth is repetitive, it will lead to soreness and irritation that may, either consciously or subconsciously, discourage the user from properly cleaning his or her back teeth.

As depicted in FIGS. 3 and 4, a portion of extending bristles 34 project from first end 24. This allows for a greater number of extending bristles 34 to be concentrated at the tip 40 of toothbrush 10, and maximizes the reach of toothbrush 10. Additionally, the bristles extending from first end 24 act as a cushion between first end 24 and the interior of the user's mouth.

As most clearly illustrated in FIG. 2, head 20 tapers so the first width 42 is less than the width 44 of handle 28. This assures that head 20 comfortably fits within constricted areas of the user's mouth. For example, during standard brushing, the sides 46,48 of head 20 do not rub against the inside of the user's cheek, and therefore head 20 is not prevented from accessing back teeth or other teeth in constricted areas. In the unlikely event that first end 24 contacts the interior of a person's mouth, first end 24 is rounded, and therefore blunt.

Referring to FIGS. 2 and 4, all of the plurality of bristles 26 lie in a plane perpendicular to top face 22. Therefore, none of the bristles 26 extend past sides 46,48. The advantages of this configuration are twofold. First, the width of head 20 is maintained at a minimum to allow head 20 to access constricted areas. Second, the amount of undesired contact between the plurality of bristles 26 and the user's cheeks and/or gums is diminished. If the plurality of bristles 26 were permitted to flare past sides 46,48 these bristles 26 would rub against the user's cheek and/or gums during normal brushing, and could cause irritation and soreness.

Brushing surface 38 is substantially planar and is parallel to the top face, with the distance between adjacent bristles being substantially consistent throughout the head 20. This assures that during brushing, the entire brushing surface 38 engages the user's teeth. The result is an even cleaning of the teeth, and an even wear of bristles 26. When a toothbrush has a raised portion of bristles, or has its bristles arranged in bundles, there is a likelihood that certain bristles will repetitively contact the teeth and gums more frequently than other bristles. In addition to possibly causing irritation to the user's cheeks and gums, this results in an uneven cleaning of the teeth, and expedites the wear of those bristles which most commonly contact the teeth. Once any of the bristles of a toothbrush become worn, the entire toothbrush should be replaced.

It is to be understood that the present invention is not limited to the sole embodiment described above, but encompasses any and all embodiments within the scope of the following claims.

I claim:

1. A toothbrush comprising:

a handle, a head, connected to said handle being said head, said head further comprising:

a top face;

a first end surface distal to said handle and being substantially perpendicular to said top face; and a first plurality of bristles extending from said top face and a second plurality of bristles attached to and extending from said first end surface, there being a portion of each of said first and second pluralities of bristles extending beyond said first end surface in a direction away from said handle, said first and second pluralities of bristles defining a single planar brushing surface parallel to said top face.

2. The toothbrush according to claim 1, wherein said first end surface is rounded.

3. The toothbrush according to claim 1, wherein said first end surface has a first width, and said head tapers from a region proximate to said handle to said first end surface, said region proximate to said handle having a width larger than said first width, and wherein said first width is less than a width of said handle.

4. The toothbrush according to claim 1, wherein each of said first plurality of bristles and said second plurality of bristles define an angle of greater than 45 degrees relative to said top face.

* * * * *